US011629521B2

(12) United States Patent
Zarkesh-Ha et al.

(10) Patent No.: US 11,629,521 B2
(45) Date of Patent: Apr. 18, 2023

(54) SUN TRACKING CANOPY STRUCTURE FOR AUTONOMOUS SHADE CONTROL

(71) Applicant: UNM Rainforest Innovations, Albuquerque, NM (US)

(72) Inventors: Payman Zarkesh-Ha, Albuquerque, NM (US); Tim Pressnail, Albuquerque, NM (US)

(73) Assignee: UNM Rainforest Innovations, Albuquerque, NM (US)

( * ) Notice: Subject to any disclaimer, the term of this patent is extended or adjusted under 35 U.S.C. 154(b) by 0 days.

(21) Appl. No.: 17/318,916

(22) Filed: May 12, 2021

(65) Prior Publication Data

US 2021/0355704 A1 Nov. 18, 2021

Related U.S. Application Data

(60) Provisional application No. 63/023,455, filed on May 12, 2020.

(51) Int. Cl.

| | |
|---|---|
| ***E04H 15/58*** | (2006.01) |
| ***E04H 15/34*** | (2006.01) |
| ***E04H 15/04*** | (2006.01) |
| *E04H 15/10* | (2006.01) |

(52) U.S. Cl.

CPC ..... *E04H 15/58* (2013.01); *E04H 15/04* (2013.01); *E04H 15/34* (2013.01); *E04H 15/10* (2013.01)

(58) Field of Classification Search

CPC ..... E04H 15/58

See application file for complete search history.

(56) References Cited

U.S. PATENT DOCUMENTS

| | | | | |
|---|---|---|---|---|
| 5,339,848 | A * | 8/1994 | Richmond | A45B 23/00 135/33.7 |
| 5,622,197 | A * | 4/1997 | Valaire | E04H 15/58 114/106 |
| 6,827,094 | B1 * | 12/2004 | Bramwells | E04H 15/003 135/120.1 |
| 7,407,178 | B2 * | 8/2008 | Freedman | A45B 11/00 280/47.38 |
| 9,528,313 | B1 * | 12/2016 | Arimilli | E06B 9/34 |
| 2004/0261953 | A1 * | 12/2004 | Hart | F24F 5/0035 160/80 |
| 2017/0318919 | A1 * | 11/2017 | Gharabegian | A45B 25/165 |

FOREIGN PATENT DOCUMENTS

| | | | | |
|---|---|---|---|---|
| DE | 4019396 | A1 * | 5/1991 | E04H 15/58 |
| DE | 202013104660 | U1 * | 1/2014 | E04F 10/02 |

* cited by examiner

*Primary Examiner* — Noah Chandler Hawk

(74) *Attorney, Agent, or Firm* — Keith Vogt, Ltd.; Keith A. Vogt

(57) ABSTRACT

A sun tracking canopy structure having a canopy positionable to maintain a shaded area based on calculated solar elevation and azimuth.

15 Claims, 18 Drawing Sheets

Time: 10:00 AM

Time: 5:00 PM

SUN TRACKING CANOPY STRUCTURE FOR AUTONOMOUS SHADE CONTROL

RELATED APPLICATIONS

This application claims priority to U.S. Provisional Application No. 63/023,455, filed on May 12, 2020, which is incorporated herein in its entirety.

BACKGROUND OF THE INVENTION

The sun moves at about 15° per hour along its path across the sky, causing a rather fast projection to the horizon, depends on the observer's latitude and the time of year. As a result, fixed shading structures (such as umbrellas or pergolas) typically fail to provide a consistent shade during the entire day.

BRIEF SUMMARY OF THE INVENTION

In one aspect, the present invention provides an embodiment that calculates sun azimuth and elevation coordinates to automatically adjust the position of a motorized canopy to provide a consistent and fixed shade on a desired location. This eliminates the need to manually displace umbrella or to move furniture in order to stay in shade during the day.

In other embodiments, even if it is left unattended, the sun-tracking canopy of the present invention provides an autonomous shade over the entire year, protecting outdoor furniture against harmful UV radiation, rain, and snow.

The embodiments of the present invention also provide a low-cost and elegant solution to many applications, including personal use (such as backyard setting, picnic and camping setting) or several commercial use (such as hotels, resorts, outdoor pool settings, restaurants and coffee shops with outdoor tables, and beach setting).

In other embodiments, the present invention relates to the use of a canopy attached to motorized platforms controlled by a microcontroller or processor (e.g., Raspberry Pi or Arduino) to provide a non-moving and static shade for consistent sun protection over specified area.

In other embodiments, the microcontroller or processor uses the captured image from a camera to identify the location of the shade and position the canopy in real time for more accurate shade control without the need for computing the sun coordinates.

In other aspects, the embodiments of the present invention also use a motorized canopy to automatically manage multiple designated areas for various conditions.

In other embodiments, the present invention provides automatic protection to areas during rain or snow using a rain sensor.

In other aspects, the sensor may be illuminated at night using attached light-weight LEDs which may be located under the canopy.

In other aspects, the present invention provides on-demand protection to any outdoor area by remote communication with a microcontroller or processor.

In other aspects, the present invention provides a sun tracking canopy structure, comprising: a canopy that is positioned by 3 or more cables attached to motorized platforms; a that calculates solar elevation and azimuth based on the latitude and longitude coordinates of the site to compute the canopy location and gives commands to the motorized platforms to maintain a fixed shade location on the designated areas.

In other embodiments, the present invention provides a sun tracking canopy structure wherein the number of motorized platforms depends on the number of corners of the canopy.

In other embodiments, the present invention provides a sun tracking canopy structure wherein the motorized platforms are mounted on dedicated poles or attached to a building structure or combination of both.

In other embodiments, the present invention provides a sun tracking canopy structure wherein the canopy is attached to the platforms by cables that are attached to self-limiting springs that are mounted to the canopy to dampen out weather effects and/or positioning errors.

In other embodiments, the present invention provides a sun tracking canopy structure wherein a rain sensor is connected to the microcontroller or processor to detect rain falls.

In other embodiments, the present invention provides a sun tracking canopy structure wherein the motorized platforms are placed at different elevations to provide enough slope to prevent standing water on the surface of a canopy.

In other embodiments, the present invention provides a sun tracking canopy structure wherein the microcontroller or processor reads the rain sensor and if rain is detected, it immediately moves the canopy over the designated area to protect it from the rain or snow.

In other embodiments, the present invention provides a sun tracking canopy structure wherein the canopy provides lighting on any desired area during the night, using light-weight LEDs attached under the canopy.

In other embodiments, the present invention provides a sun tracking canopy structure, wherein the is accessed remotely, for example by a phone app over Wi-Fi, to control the canopy location and/or set multiple designated areas for desired shades at any time on demand.

In other embodiments, the present invention provides a sun tracking canopy structure wherein a GPS chip is connected to the microcontroller or processor, to provide local time and the latitude and longitude of the location directly to the microcontroller or processor.

In other embodiments, the present invention provides a sun tracking canopy structure wherein the low-voltage power supply for the LEDs is delivered through the holding cables attached to the canopy.

In other embodiments, the present invention provides a sun tracking canopy structure wherein the microcontroller or processor uses an image captured from a camera to identify the location of the shade and position the canopy in real time for more accurate shade control without the need for computing the sun coordinates.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

In the drawings, which are not necessarily drawn to scale, like numerals may describe substantially similar components throughout the several views. Like numerals having different letter suffixes may represent different instances of substantially similar components. The drawings illustrate generally, by way of example, but not by way of limitation, a detailed description of certain embodiments discussed in the present document.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure, or system. Further, the terms and phrases used herein are not intended to be limiting, but rather to provide an understandable description of the invention.

Reference will now be made in detail to the present embodiments, examples of which are illustrated in accompanying drawings. The numerical ranges and parameters setting forth the broad scope of the invention are approximations, and the numerical values set forth in the specific examples are reported are precisely as possible. Any numerical value, however, inherently contains certain errors necessarily resulting from the standard deviation found in their respective testing measurements.

The following embodiments are described for illustration purpose only with reference to the Figures. Those of skill in the art will appreciate that the following description is exemplary in nature, and that various modifications to the parameters set forth herein could be made without departing from the scope of the present invention. It is intended that the specification and examples be considered as examples only. The various embodiments are not necessarily mutually exclusive, as some embodiments can be combined one or more other embodiments to form new embodiments.

Figure 1:
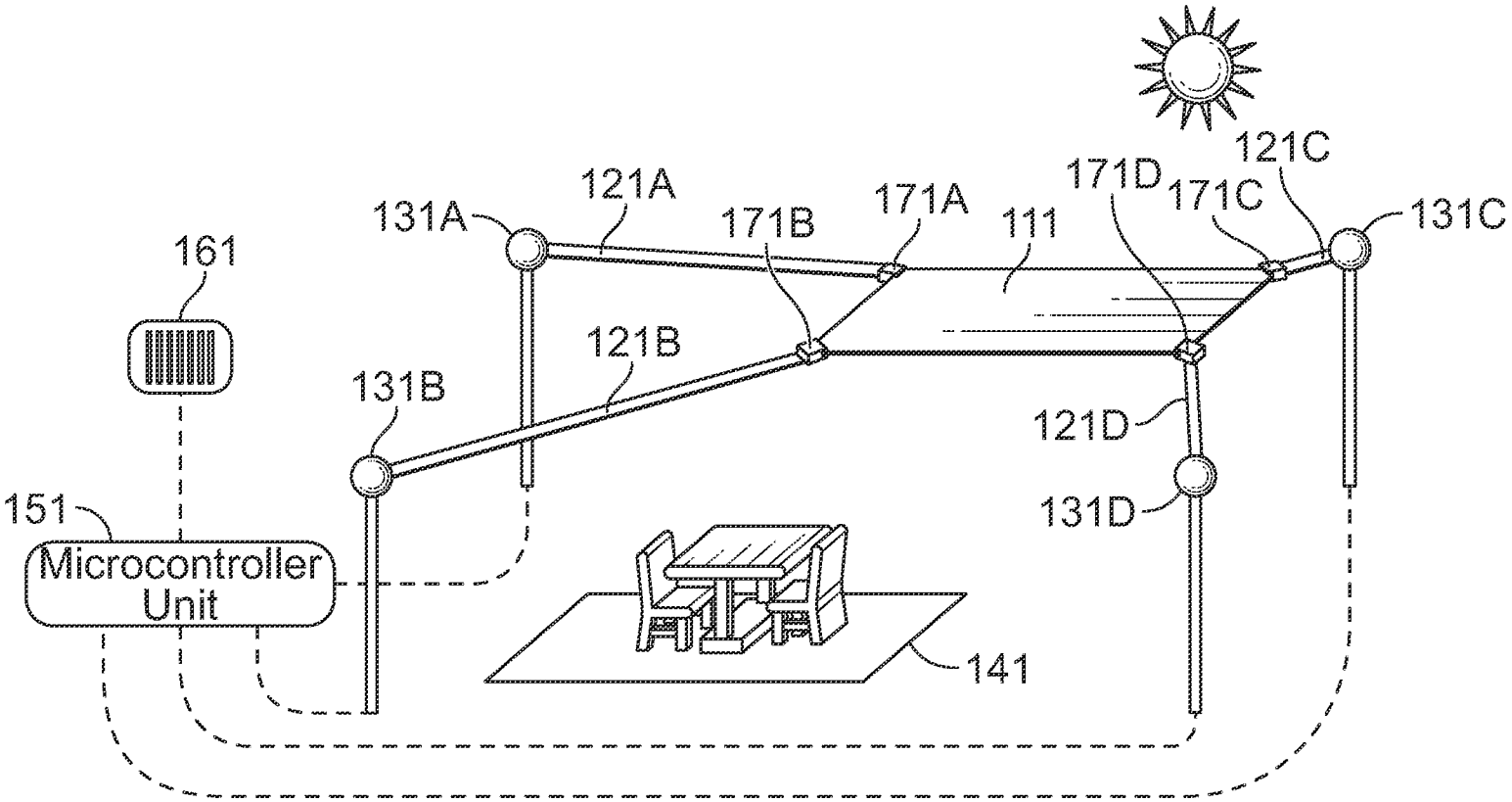
FIG. 1 illustrates a first embodiment of the present invention shows a block diagram of the invented sun-tracking canopy that is positioned by 4 cables attached to motorized platforms that are manipulated by a microcontroller or processor in order to maintain a fixed shade on the designated area for an embodiment of the present invention.

A block diagram of the invented sun-tracking canopy is illustrated in FIG. 1, where the canopy 111 is attached by cables 121A-121D to motorized platforms 131A-131D. While a four-sided canopy is shown, other configurations may be used such as circular and triangular shapes as well.

The motorized canopy is manipulated by a microcontroller or processor 151 in order to maintain a fixed shade area 141 on a designated area. A rain sensor 161 is used to automatically position the canopy on a specified area during rain or snow falls.

After positioning the canopy on a desired location, the microcontroller or processor continues adjusting the canopy's position in real time, by computing the sun azimuth and elevation coordinates in a regular basis, for example once every 10 minutes. Several resources are readily available to calculate the sun coordinates as a function of the latitude and longitude of the site, day of year, and time that can be used in the presented invention. For example, solar position calculations is available at the NOAA Earth System Research Laboratories (ESRL), located at the David Skaggs Research Center in Boulder, Colo. (https://www.esrl.noaa.gov). The detail calculations can be found at https://www.esrl.noaa.gov/gmd/grad/solcalc/solareqns.PDF.

The microcontroller or processor uses the change in sun coordinates, to compute the change in canopy's position. Appropriate commands are sent to the motorized platform to move the canopy to adjust its position.

Figure 6:
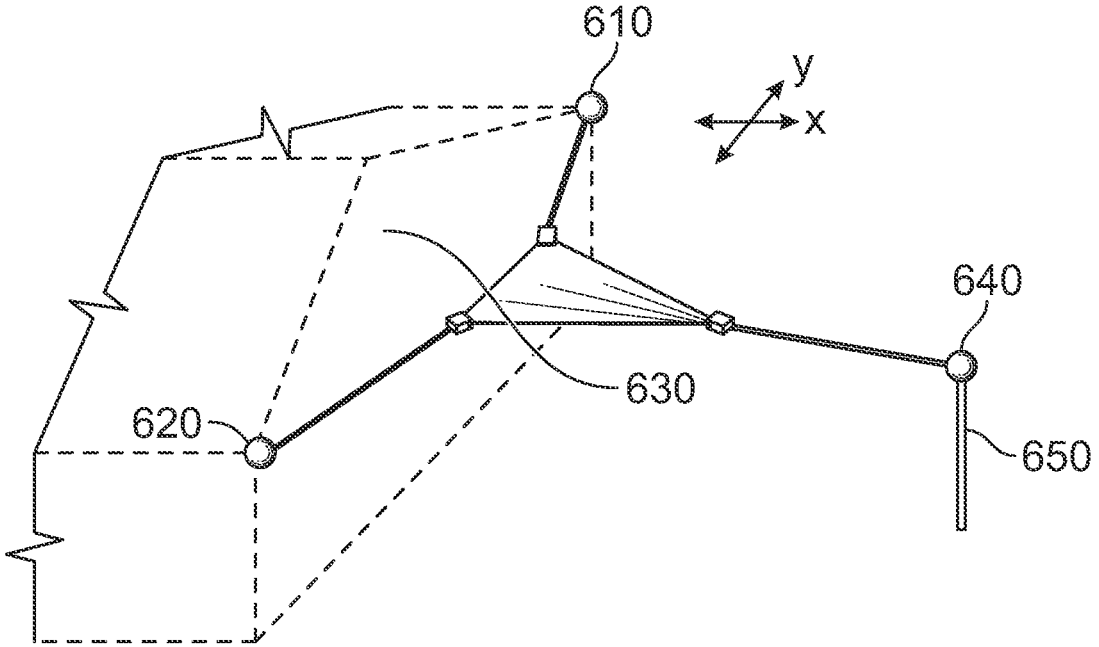
FIG. 6 shows another embodiment of this invention, wherein the motorized platforms are mounted on combination of dedicated poles and a building structure. In addition, various shapes for the canopy are also shown in this embodiment; rectangular canopy with 4 motorized platforms and triangular canopy with 3 motorized platforms.

As shown in FIG. 6, motorized platforms 610 and 620 may be mounted on a building structure 630 while other motorized platforms such as 640 is mounted on vertical support 650. In addition, as illustrated, the number of motorized platforms depends on the canopy's shape. For example, a rectangular canopy needs 4 motorized platforms, whereas a triangular canopy needs 3 motorized platforms.

The canopy is attached to the platforms by steel cables that are attached to self-limiting springs 171A-171D, as shown in FIG. 1, that are mounted to the canopy. The self-limiting springs act to dampen out weather effects and positioning errors.

Figure 7:
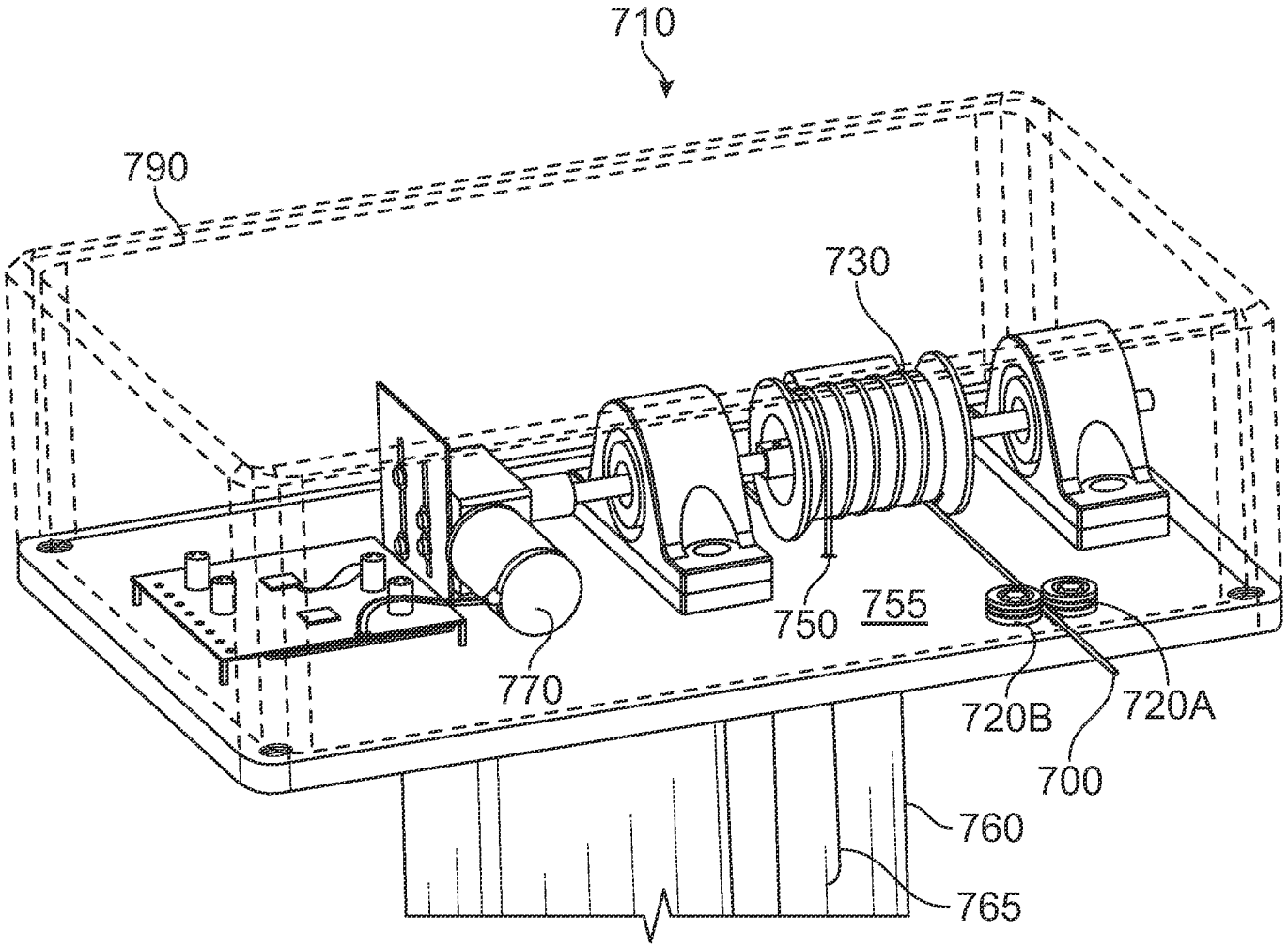
FIG. 7 shows a detailed motorized platform that may be used with the embodiments of the present invention.

As shown in FIG. 7, cable 700 runs to motorized platform 710 through bearings 720A and 720B that control the incoming position of the cable to the cable spool as illustrated. Cable 700 is wrapped around cable spool 730 which may have grooves to receive cable 700. The grooves aids in the friction between the cable and the cable spool. A spring-loaded tensioning roller parallel to the cable spool may also be used to reduce cable slack on the cable spool.

Excess cable 765 is dropped through opening 750 in the platform plate 755 into a container 760 such as a PVC pipe where it self-winds. The cable spool is driven by a worm drive motor 770. The worm drive motor may be further designed to maintain tension on the cable without being powered. The platform is covered by a weatherproof cover 790.

Figure 8:
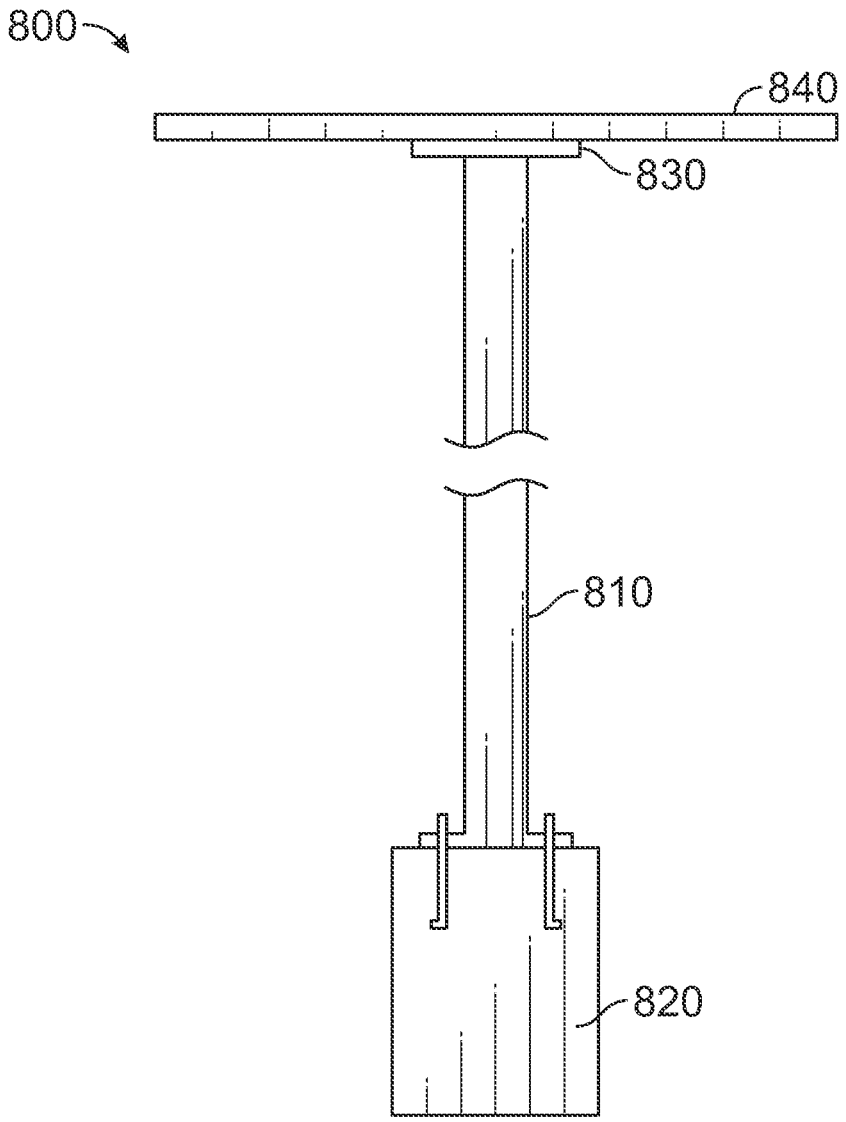
FIG. 8 shows how motorized platforms that may be used with the embodiments of the present invention may be mounted.

FIG. 8 shows an example of preferred mounting system 800. Mounting system 800 may include vertical support 810 and foundation 820. In other embodiments, to provide more angular freedom to the cables holding the canopy, a rotation stage 830 can be placed under the motorized platform 840, allowing the platform to rotate in any angle that the tension is creating. This approach will give full 360-degree angle freedom from the pole it is mounted to.

The maximum length of the cables is calculated using the locations of the motorized platforms and the size of the canopy under extreme locations, for example as shown in FIG. 9, where for the coverage are of 45' by 45' and canopy size of 12' by 12', the minimum and maximum length of cables are 0' and 47', respectively.

Figure 10:
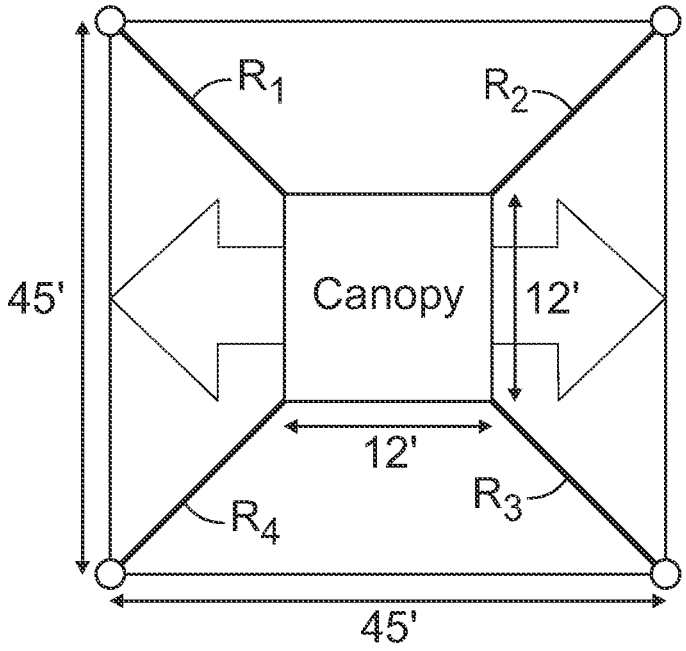
FIG. 10 shows an example of calculated lengths of the cables (R1-R4) as a function of canopy positions when it is moved horizontally.
Figure 10:
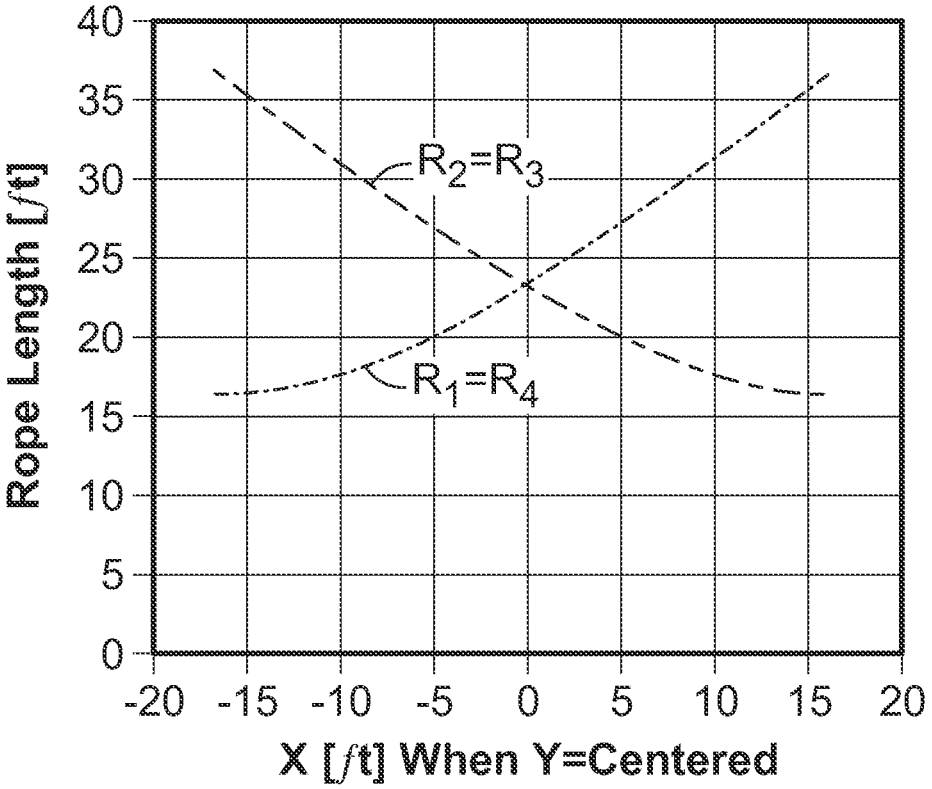
Figure 11:
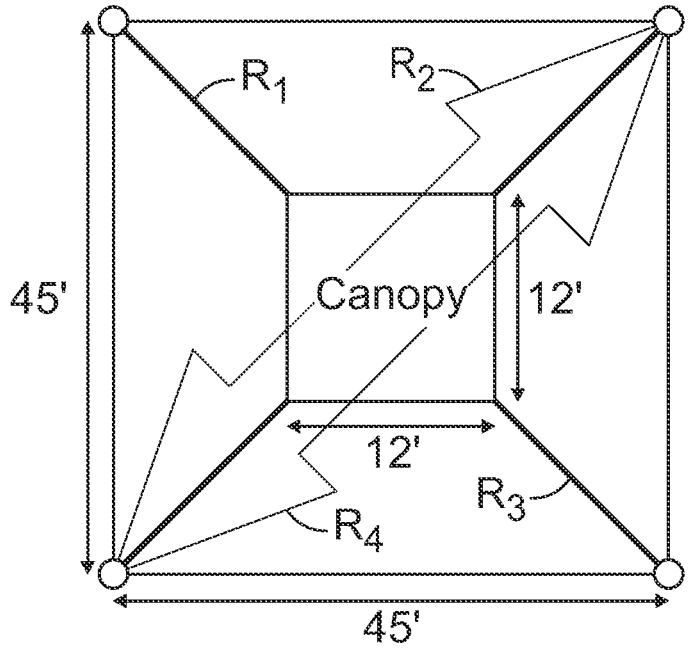
FIG. 11 shows an example of calculated lengths of the cables (R1-R4) as a function of canopy positions when it is moved diagonally.
Figure 11:
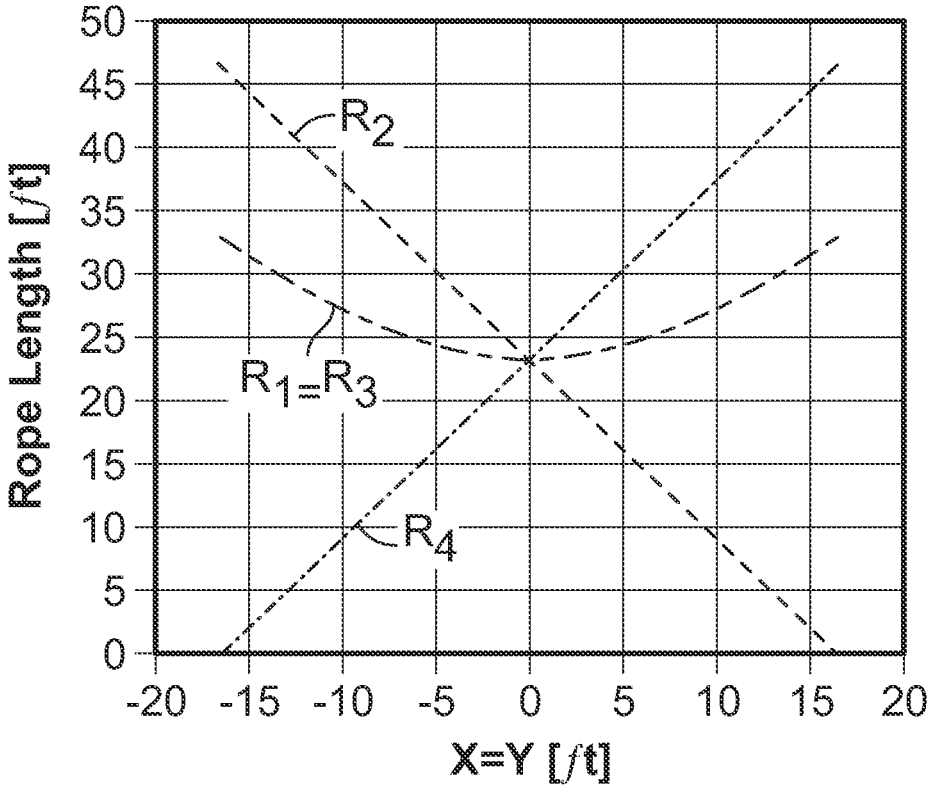
Figure 12:
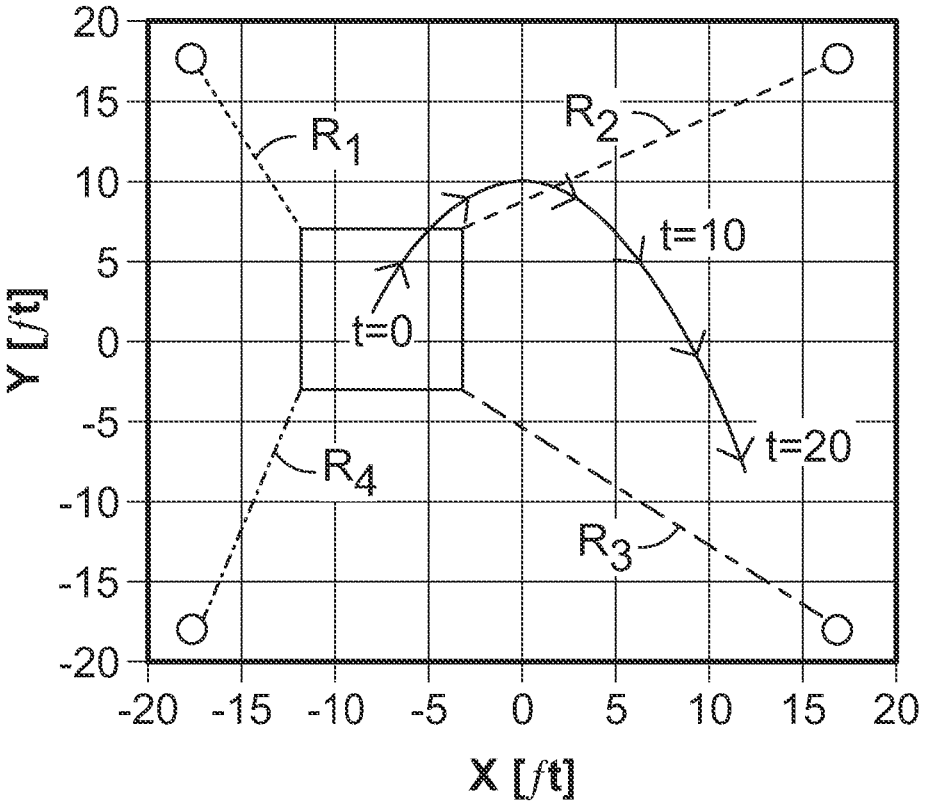
FIG. 12 shows an example of calculated lengths of the cables (R1-R4) as a function of canopy positions when it is moved within arbitrary trajectory.
Figure 12:
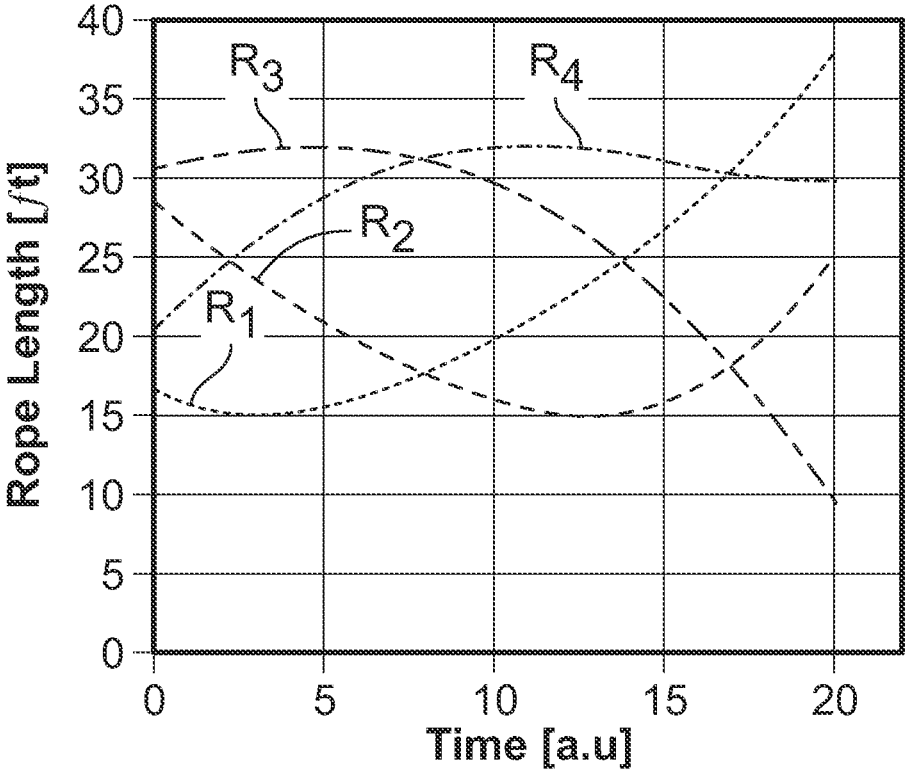

For the same setting, as illustrated in FIGS. 10-12, the length of each cable (R1-R4) is calculated for any trajectory that the canopy needs to be moved. All calculations are performed by the microcontroller or processor.

As a practical example, for an observer located in Albuquerque, N. Mex., USA (latitude=35°,5',0" and longitude=106°,39',0"), at 2:00 PM local time on May 1, 2020, the sun azimuth and elevation are computed as 216.26° and 66.61°, respectively.

After 15 minutes, at 2:15 PM, the sun azimuth and elevation will change to 223.61° and 64.64°, respectively. As a result, during the 15 minutes, the shade of a canopy placed 10' above ground moves 0.48" toward South and 8.28" toward East.

Therefore, the motorized platforms of this invention move the canopy 0.48" toward North and 8.28" toward West to maintain the shade at the same location it was at 2:00 PM.

Figure 2A:
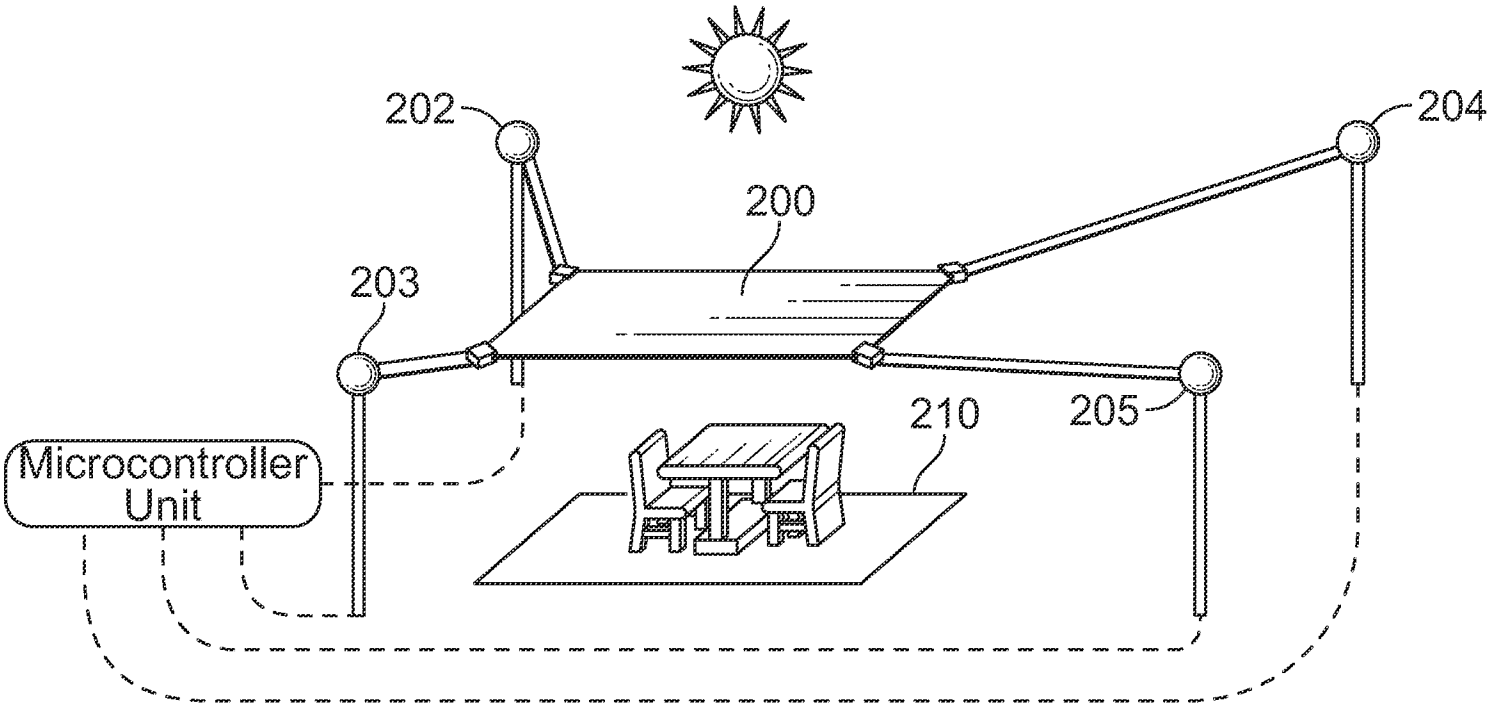
FIGS. 2A and 2B show an example of the sun-tracking canopy that provides shade on a fixed designated location, despite the movements of the sun during the day, by adjusting the canopy's position with the cables attached to the motorized platforms for an embodiment of the present invention.
Figure 2B:
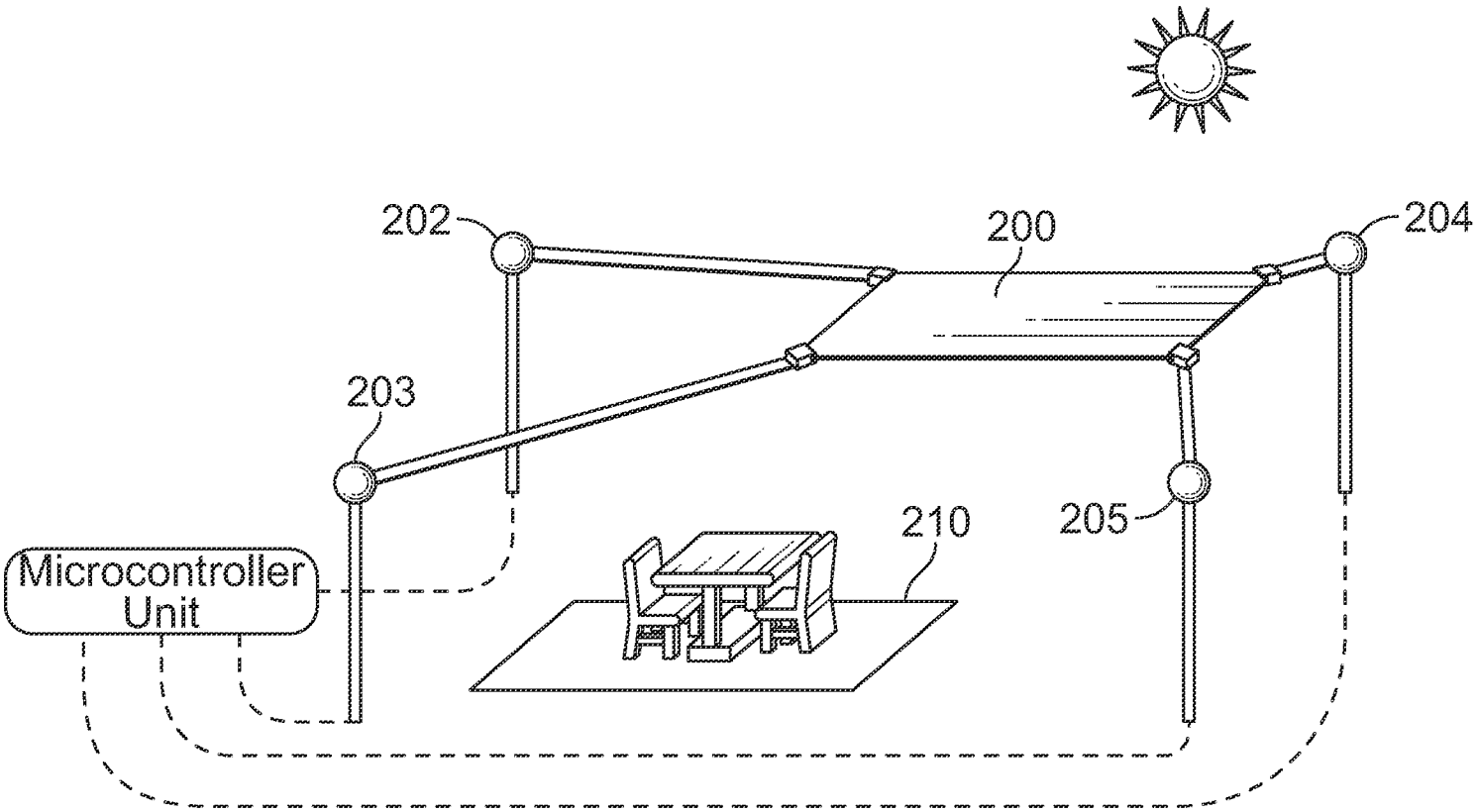

FIG. 2A shows how canopy 200 is in a first position at 10:00 AM closer to motorized platforms 202 and 203 than motorized platforms 204 and 205 to shade area 210. FIG. 2B shows how canopy 200 has at 5:00 PM transitioned to a second position closer to motorized platforms 204 and 205 than motorized platforms 202 and 203 to continue to shade area 210.

In other embodiments, a GPS chip can also be used to provide local time and the latitude and longitude of the location directly to the microcontroller or processor, eliminating the need for the user to provide any information during installation.

Figure 3:
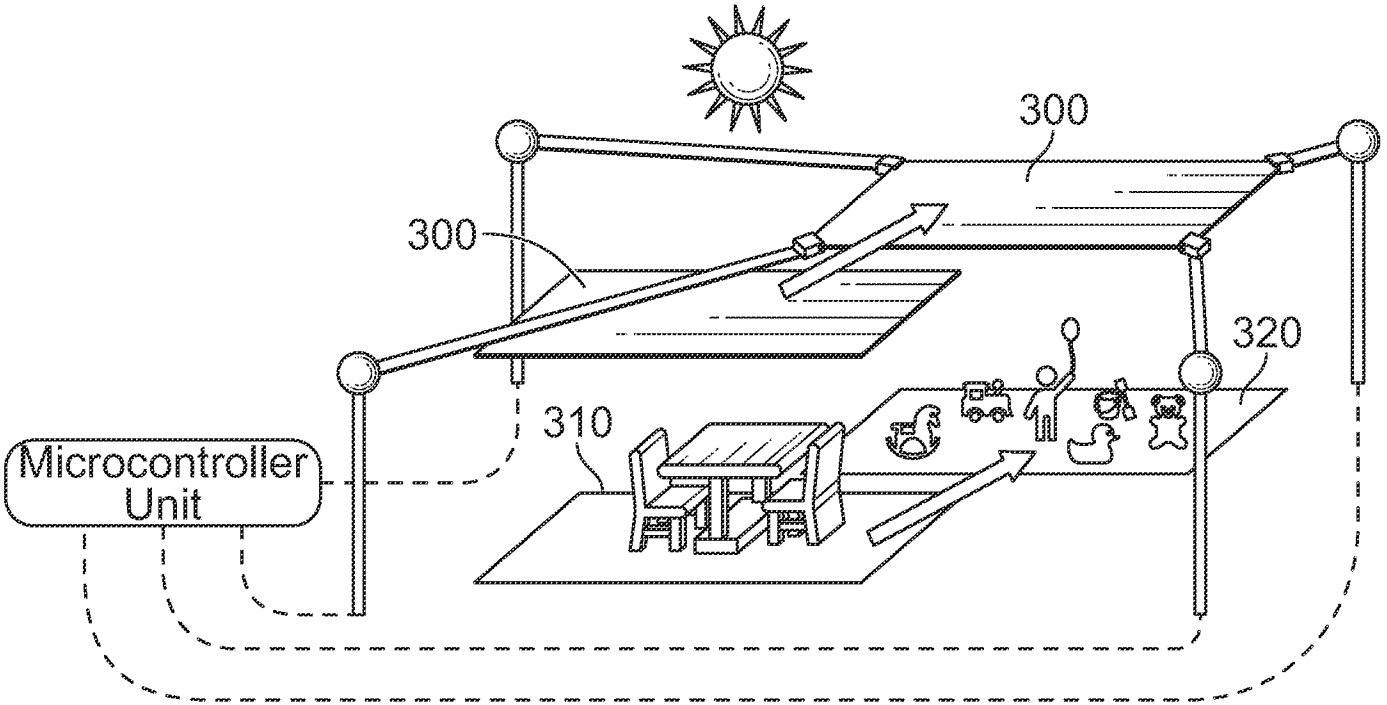
FIG. 3 shows an example of the sun-tracking canopy that is positioned at various designated areas on demand in real time for an embodiment of the present invention.

The presented invention provides valuable opportunities to move the motorized canopy over multiple designated areas stored in the microcontroller or processor or on demand. As shown in FIG. 3, canopy 3 is positioned to provide shade to area 310. In addition, the microcontroller or processor can give the flexibility to move the canopy in any location such as area 320 by using a phone app over Wi-Fi.

Figure 4:
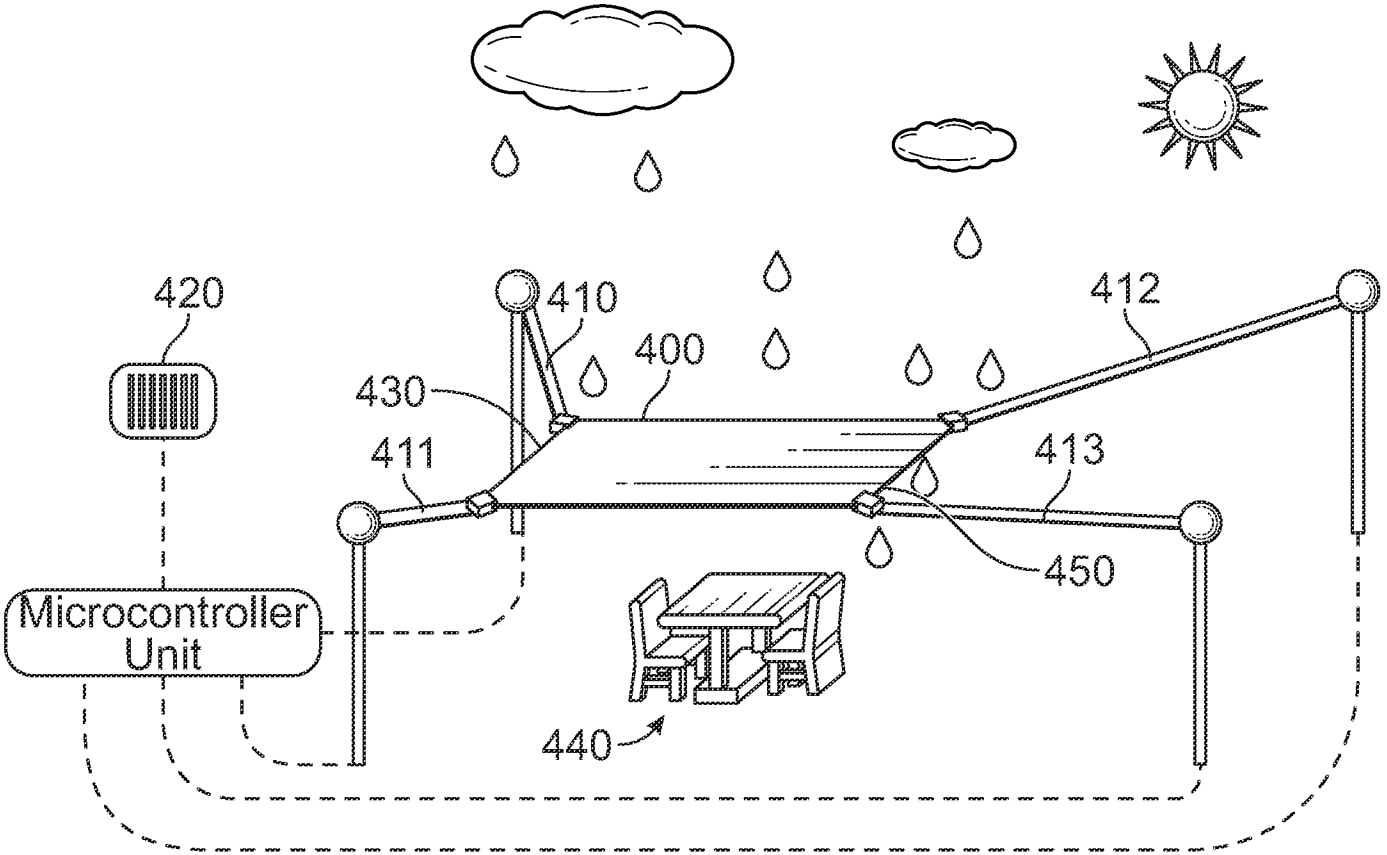
FIG. 4 shows an example of the sun-tracking canopy that uses the rain sensor to automatically position itself on a specified designated area during rain or snow falls and how the slope of the canopy prevents any standing water on the surface of canopy for an embodiment of the present invention.
Figure 5:
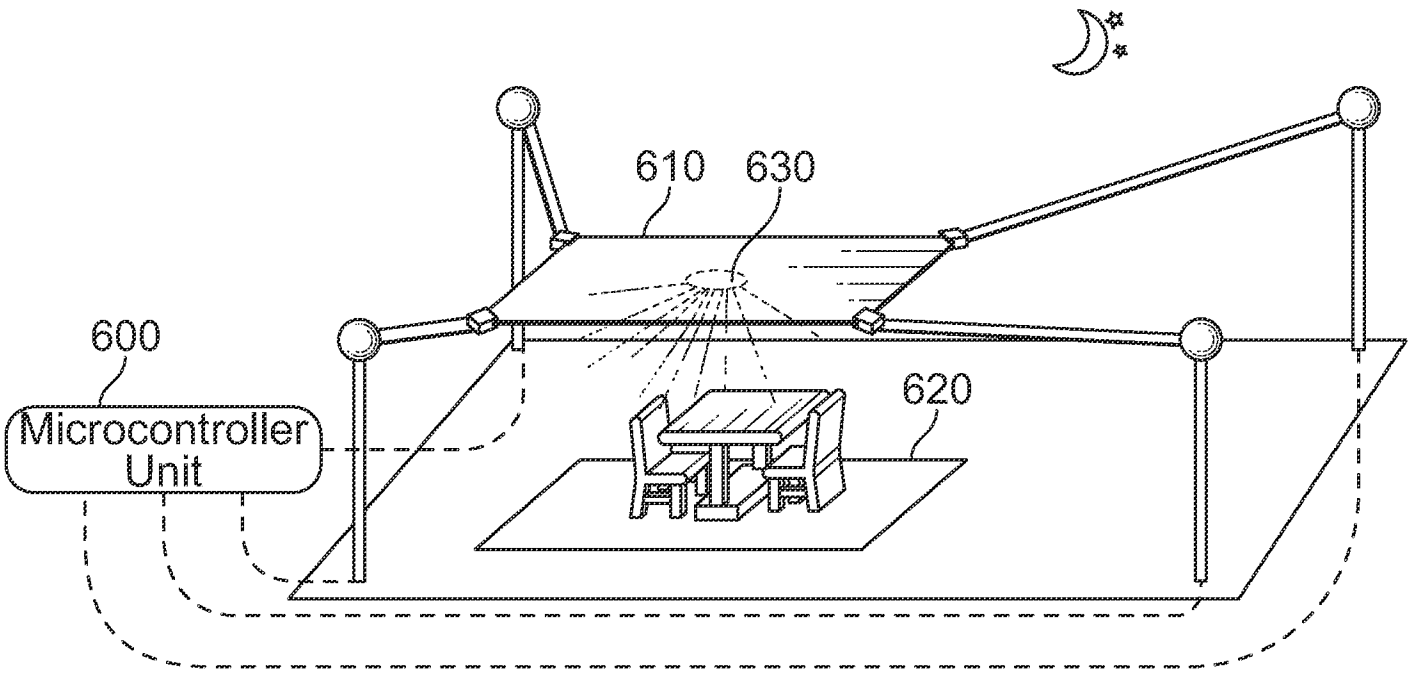
FIG. 5 shows an example of the sun-tracking canopy that is positioned at a designated area at night to provide lighting, using light-weight LEDs attached under the canopy for an embodiment of the present invention that may have various canopy such as shapes.

FIG. 4 shows an example of sun-tracking canopy 400 that uses rain sensor 420 to automatically position itself on a specified designated area 440 during rain or snow fall. Also, canopy 450 may be sloped by the manipulation of cables 410-413. For example, once edge 430 of canopy 400 is properly positioned, edge 450 can be lowered creating a slope by increasing the length of cables 412 and 413, such as be a release of tension, while maintaining the lengths of cables 410 and 411. Sloping the canopy as desired prevents any standing water on the surface of canopy for this embodiment of the present invention.

Figure 9A:
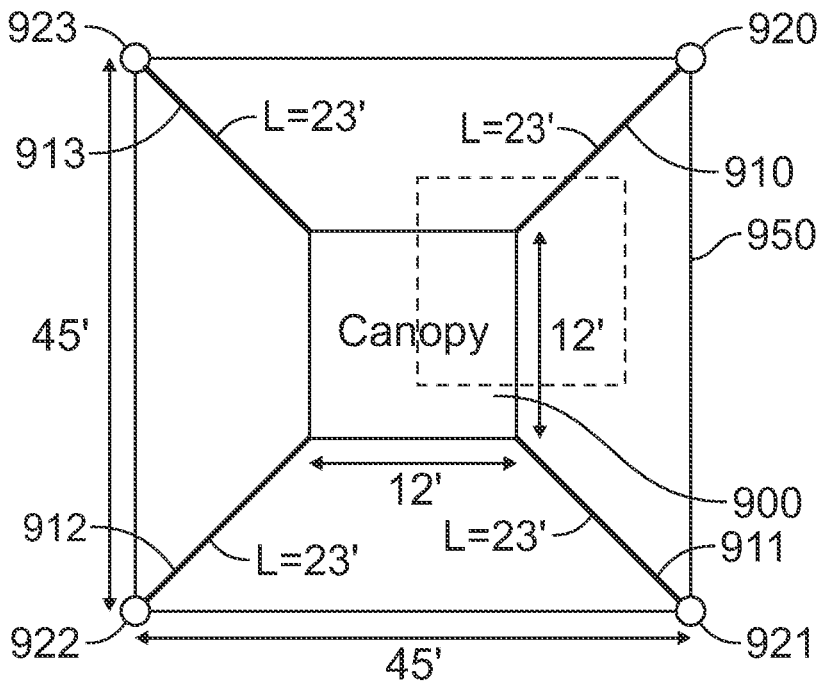
FIG. 9A is a top-view of a canopy positioned in nominal (e.g., center).
Figure 9B:
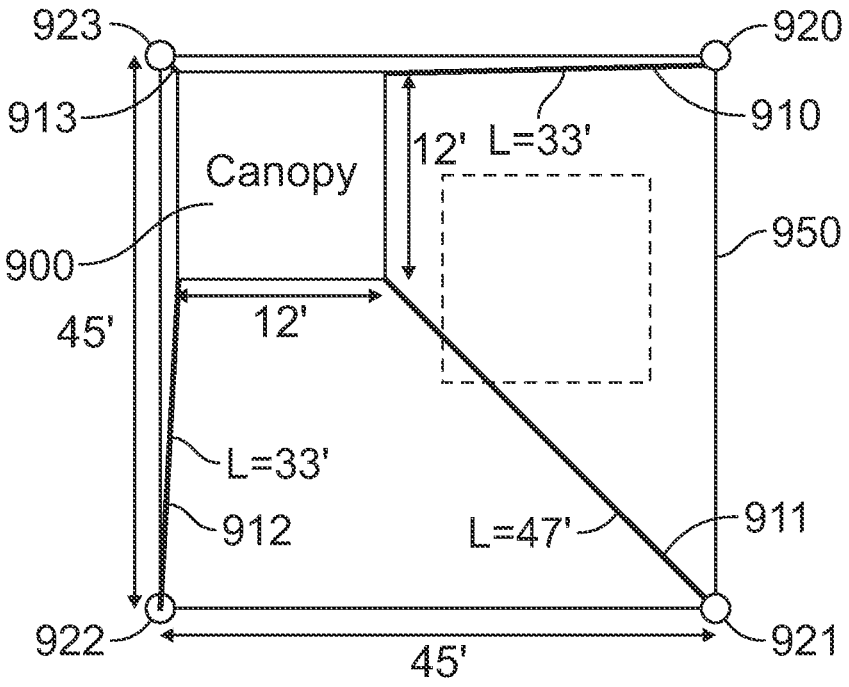
FIG. 9B is a top-view of a canopy positioned in a corner.

FIGS. 9A and 9B shows two top-view examples of canopy positions in nominal (e.g., center) and extreme (e.g., one corner) locations to demonstrate the length of cables at various locations on how the cables must be able to move in an arc. As shown in FIG. 9A, canopy 900 is in a central position and cables 910-913 are all positioned inwardly towards the center of perimeter 950 defined by motorized platforms 920-923. To located canopy 900 in a corner, as shown in FIG. 9B, cables 920 and 922 need to change orientations and move to locations that are substantially parallel to the edges of perimeter 950.

For example, the microcontroller or processor can use a rain sensor to immediately and automatically move the motorized canopy over designated area 1. In addition, as shown in FIG. 6, microcontroller or processor 600 can compute the time of sunset, based on the sun position, and automatically have canopy 610 moved to a predetermined area to illuminate the area using light source 630.

Worm drive motor 770 is used to hold the cable at a set location without keeping power on the motor. However, when the canopy whipped around in high wind conditions, worm drive motor 770 would fail. To remedy this situation, brake assembly 1300 is provided. Assembly 1300 consist of brake rotor 1310, brake disc 1320, tension idler bearing 1330, linear actuator 1340 and brake cable 1350. Also provided are control electronics 1360 which operates the assembly. Control electronics 1360 is configured to apply the brake to keep the cable spool stationary when the canopy is not being adjusted.

Figure 14:
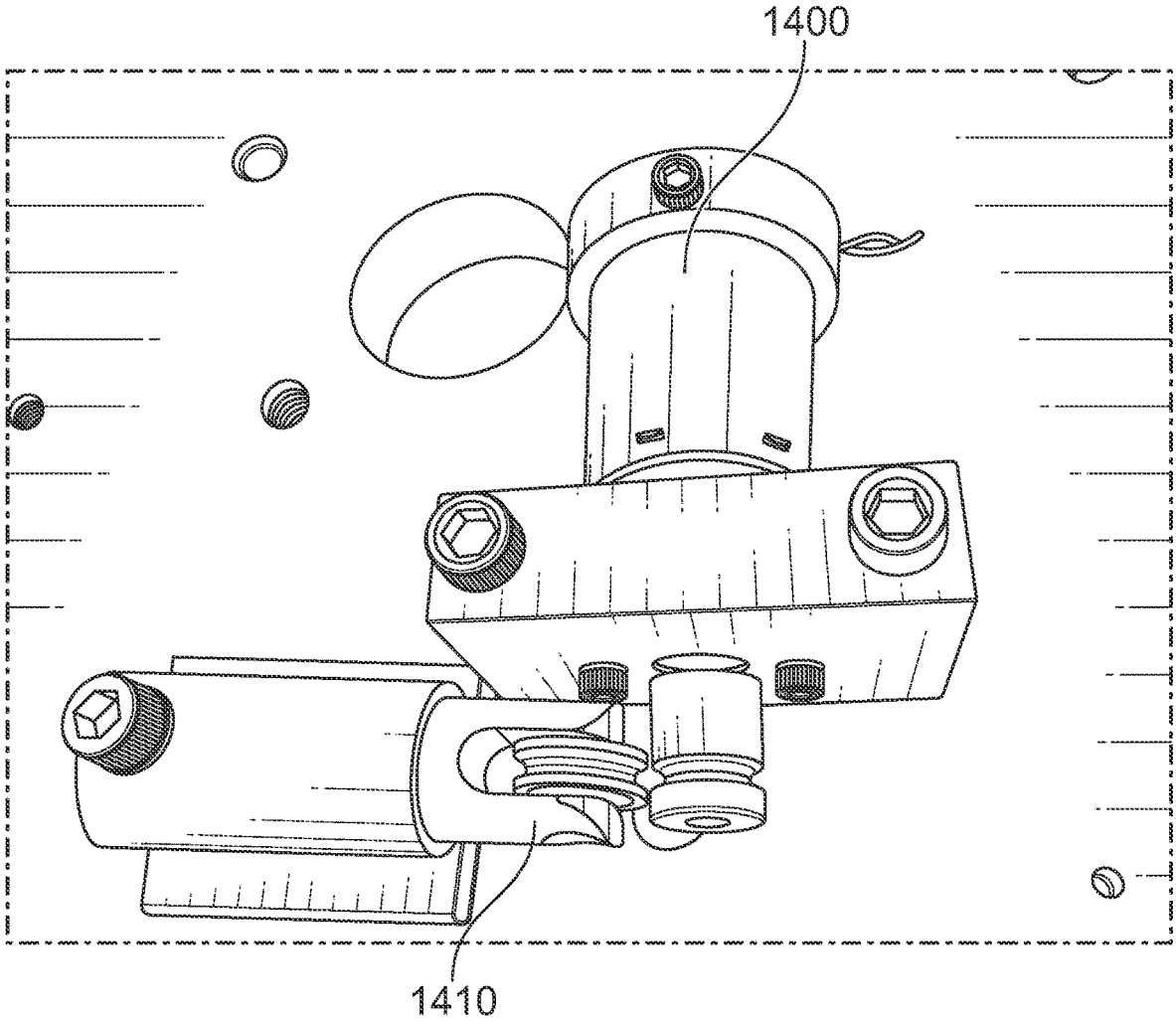
FIG. 14 shows a bottom cable spooler assembly for an embodiment of the present invention.

It was also found the cable going down into container 760 may not be heavy enough to keep tension on cable spool 730. Not having enough tension on the cable spool causes the cable to slip and the cable tangles up in the spool. A solution to this is to control the tension on the cable as it is played in or out. To do this, as shown in FIG. 14, planetary gear motor 1400 and cable tensioner 140 are used to control the cable. As the cable is played in, the cable is being moved down the pole, the motor is running keeping tension on the cable. When it is being played out, the motor is off and the friction between the motor pulley and the spring tensioner keeps tension on the cable.

Figure 15:
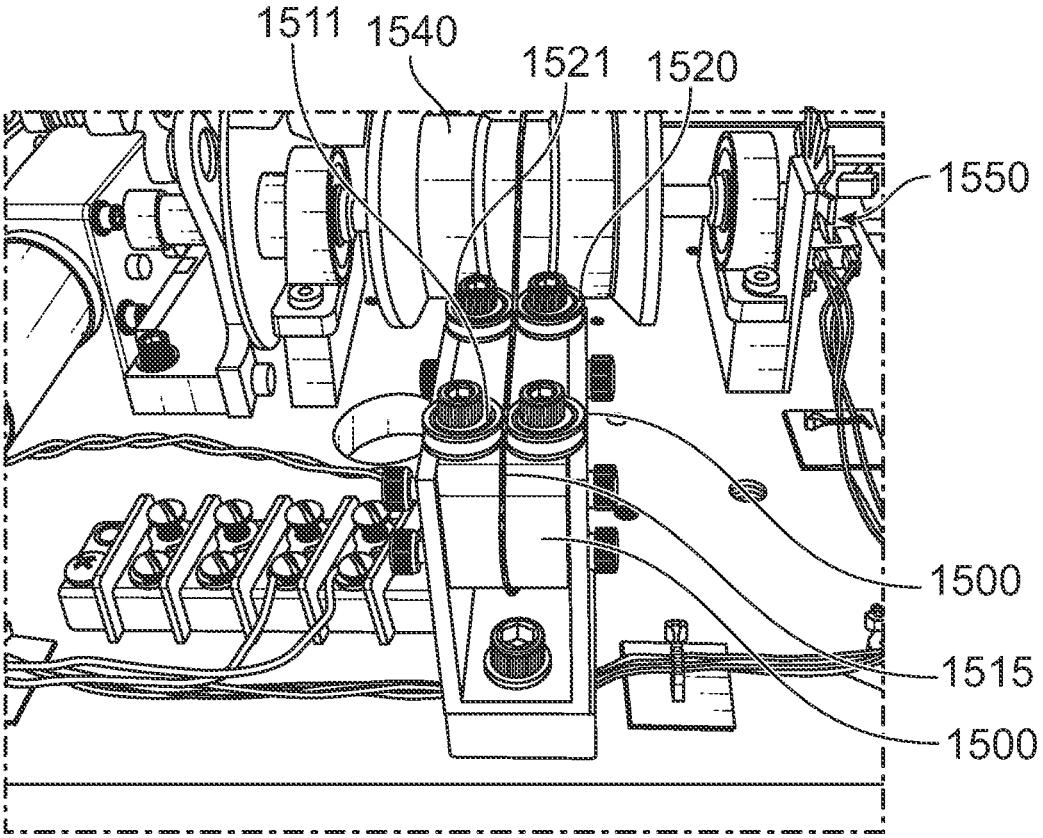
FIG. 15 shows a cable block guide assembly for an embodiment of the present invention.

As shown in FIG. 15, cable block guide 1500 may be used with the embodiments of the present invention. Cable block guide 1500 consists of front set of grooved bearings which may be U bearings 1510 and 1511 defining a cable opening 1515. A second of rear set of grooved bearings 1520 and 1521 may also be provided.

Also shown in FIG. 15 is spool 1540 and cable length counter 1550. Counter 1550 tracks the turns of spool 1540.

The front set of U bearings allows the cable to play out if necessary, at nearly 90-degree angles from the pole. When the poles are set in place each one is aligned to the canopy starting location. The second set ensures the cable is aligned to the spool no matter the position of the cable on the front set of U bearings.

Figure 13:
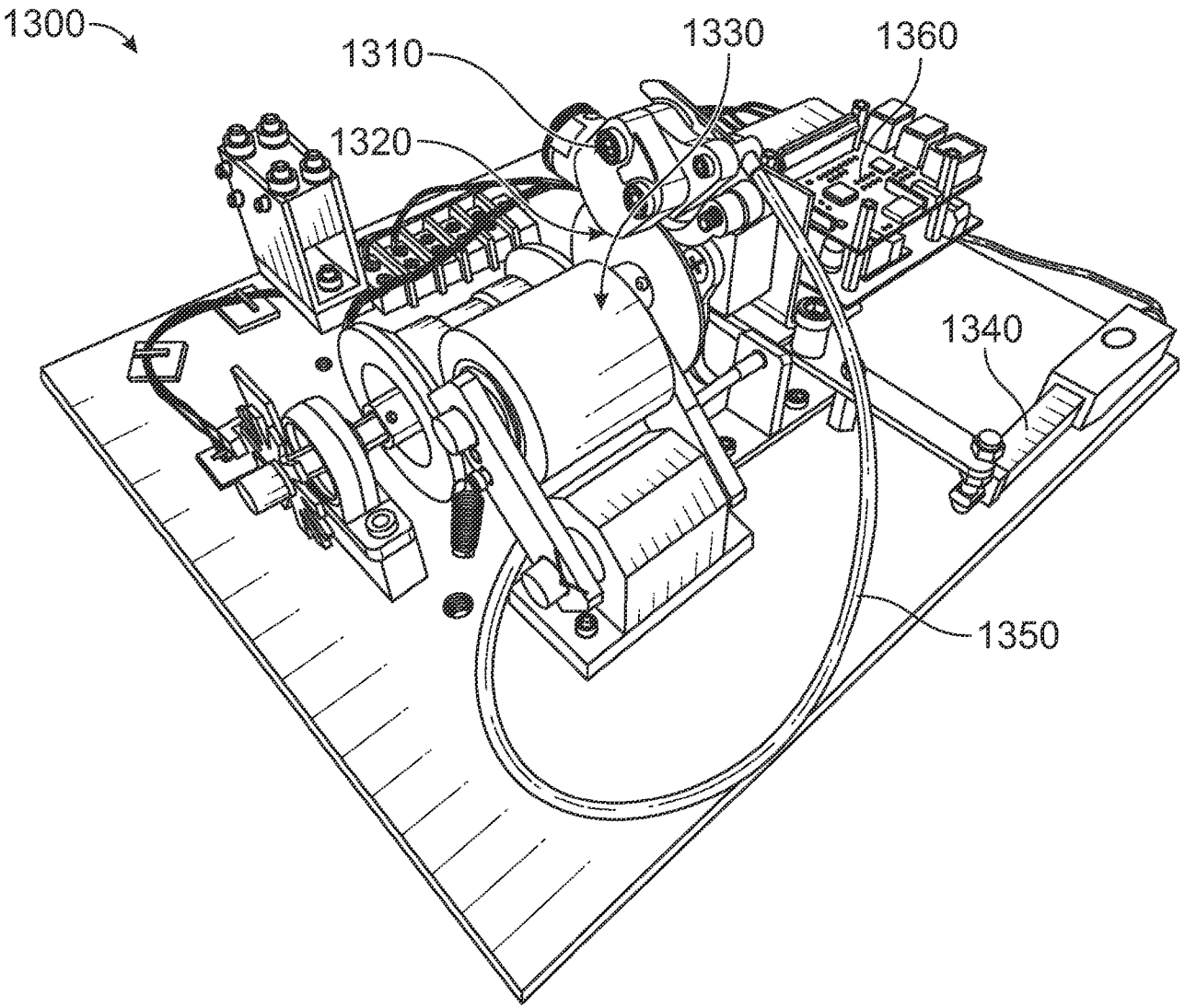
FIG. 13 shows a cable brake assembly for an embodiment of the present invention.

In a preferred use, cable is wrapped three times around the cable spool. Two wraps and the cable will slip on the spool under tension. Four wraps and the cable will not slip over on the spool shoulder to allow the incoming cable to wind properly. As shown in FIG. 13, tension idler bearing 1330 ensures the cable stays lined up on the spool.

Figure 16A:
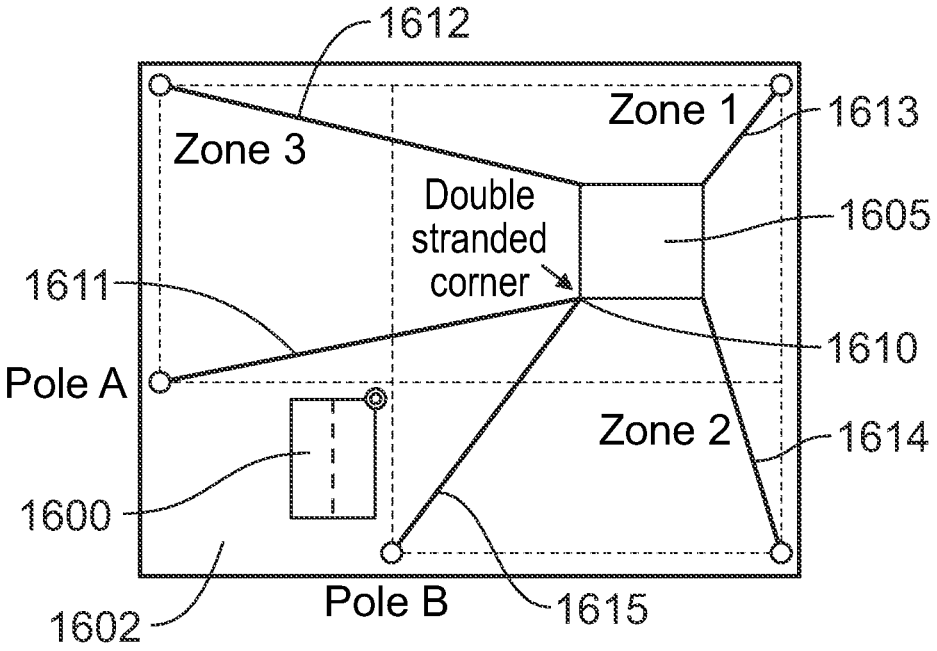
FIGS. 16A, 16B, and 16C shows an assembly and method for positioning a canopy around an obstacle.
Figure 16B:
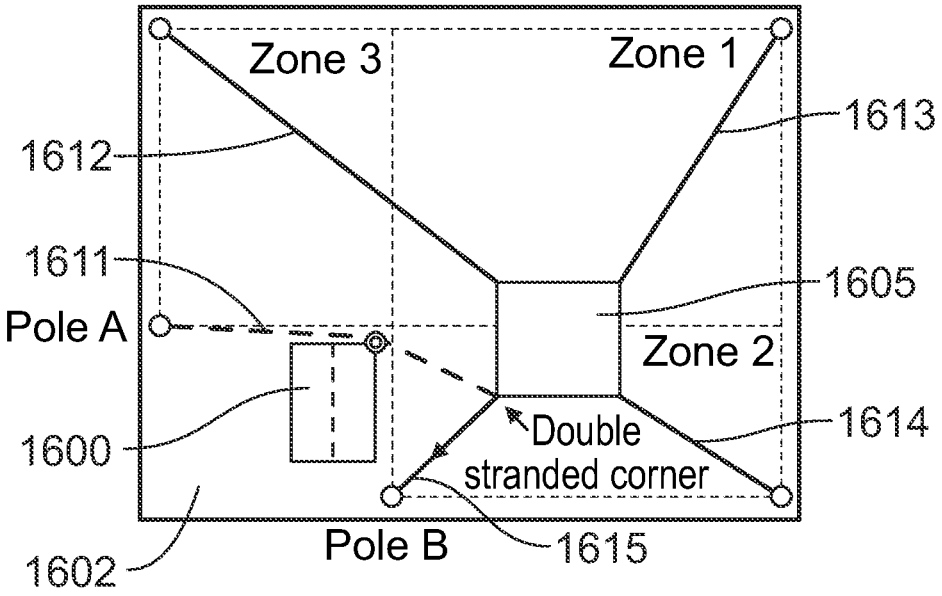
Figure 16C:
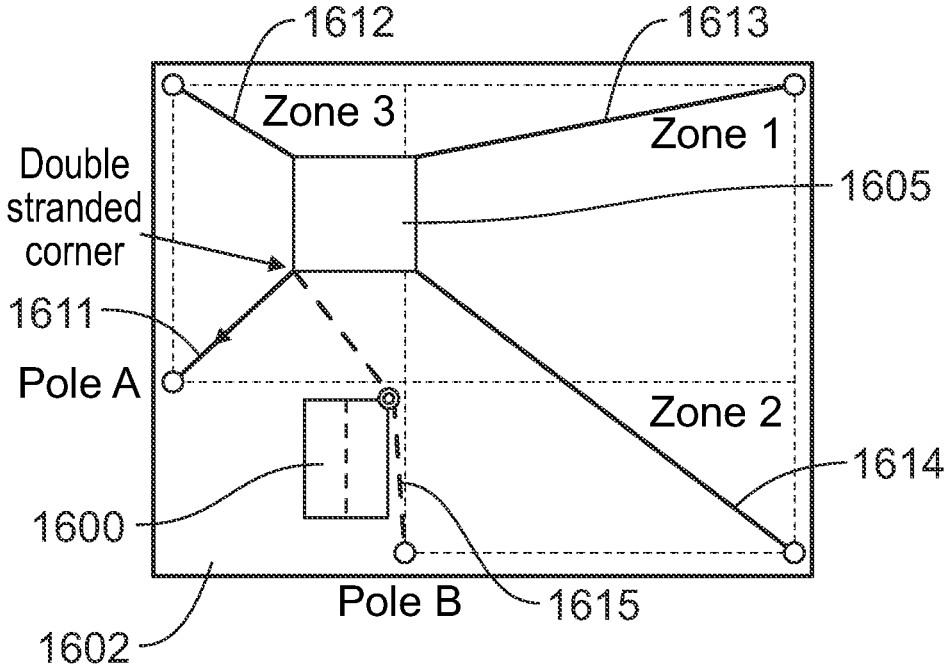

FIGS. 16A-16C illustrate additional embodiment of the present invention that may be used to maneuver canopy 1605 when there are movement zones having obstacles 1600 (e.g., due to large trees, building structure, or non-rectangular coverage area). For this embodiment, canopy 1605 can be controlled by one or more double-stranded connections points. In a preferred embodiment the connection point is one of corners. In other embodiments, the connection points are spaced a short distance apart.

FIG. 16A shows obstacle 1600, canopy 1605 and cables 1611-1615. As further shown in FIG. 16A, obstacle 1600 is within area or zone 1602 which is defined by cables 1611 and 1615 and their connection point 1610 which is a corner but may be one or more points along canopy 1605.

A double stranded corner may be comprised of cables 1611, 1615 and corner 1610. Cables 1611-1615 are used to position canopy 1605 when the canopy is in Zone 1.

FIG. 16B shows that when the "double stranded corner" of the canopy is in Zone 2, only cable 1615 is used to position the canopy. Cable 1611 is only pulled enough to keep it straight without putting any tension on the pulley.

As shown in FIG. 16C, when the "double stranded corner" of the canopy is in Zone 3, only cable 1611 is used to position the canopy. Cable 1615 is only pulled enough to keep it straight without putting any tension on the pulley.

In other embodiments, the microcontroller or processor uses the captured image from a camera to identify the location of the shade. With this information, the canopy may be positioned by the processor to shade a predetermined area.

In use, based on the embodiments described above, a processor calculates a first solar elevation and azimuth based on the latitude and longitude coordinates of the structure at a first period of time. Then, later in time, or at predetermined intervals, the processor calculates a second solar elevation and azimuth based on the latitude and longitude coordinates of the structure at a second period of time. The second solar elevation and azimuth is different than the first calculated solar elevation and azimuth as a result of the movement of the sun.

The processor uses the first calculated solar elevation and azimuth and the second calculated solar elevation and azimuth to position the canopy in a location to shade the same predetermined area. This allows, for example, a table to remain in a shaded area throughout a given time period.

As also described above, positioning of the canopy is performed by having the processor work in conjunction with each motorized platform, to change a cable length, which may be the distance between the motorized platform and the canopy. During the course of positioning the canopy overtime, the length of each cable attached to the canopy will change.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above-described embodiments, methods, and examples, but by all embodiments and methods within the scope and spirit of the disclosure.

What is claimed is:

1. A sun tracking canopy structure, comprising:

a canopy;

a processor adapted to calculate a first solar elevation and azimuth based on the latitude and longitude coordinates of the structure at a first period of time;

said processor adapted to calculate a second solar elevation and azimuth based on the latitude and longitude coordinates of the structure at a second period of time;

said second period of time is later in time than said first time period and said;

said calculated second solar elevation and azimuth is different than said first calculated solar elevation and azimuth;

a plurality of cables, each cable having one end attached to said canopy and an opposing end connected to one of a plurality of motorized platforms and wherein each cable has a cable length defined by the distance between the motorized platform and said canopy;

said cable length of each of said cables is different at said first period of time than at said second period of time;

said cables are attached to self-limiting springs that are mounted to said canopy;

said processor uses said first calculated solar elevation and azimuth and said processor uses said second calculated solar elevation and azimuth to position said canopy in a location to shade the same predetermined area at said first period of time and said second period of time; and wherein each of said motorized platforms includes a brake configured to keep said canopy stationary when said canopy is not being adjusted.

2. The sun tracking canopy structure of claim 1, wherein a rain sensor is connected to the processor to detect rain fall.

3. The sun tracking canopy structure of claim 2, wherein said processor reads the rain sensor and if rain is detected, it moves said canopy to a designated area.

4. The sun tracking canopy structure of claim 3, wherein said canopy provides lighting a predetermined at a predetermined period of time.

5. The sun tracking canopy structure of claim 3, wherein a GPS is connected to said processor to provide local time and the latitude and longitude.

6. The sun tracking canopy structure of claim 1, wherein said processor uses a captured image from a camera to identify the location of said canopy in real time.

7. The sun tracking canopy structure of claim 1, wherein two of said cables form a double stranded connection point.

8. The sun tracking canopy structure of claim 7, wherein two of said cables form a double stranded connection point and both of said cables forming said double stranded connection point are used to position said canopy.

9. The sun tracking canopy structure of claim 7, wherein two of said cables form a double stranded connection point and one of said cables forming said double stranded connection point is used to position said canopy.

10. The sun tracking canopy structure of claim 7 wherein two of said cables form a double stranded connection point and one of said cables forming said double stranded connection point is used to position said canopy around an obstruction.

11. The sun tracking canopy structure of claim 1 wherein each of said motorized platforms is rotatable.

12. The sun tracking canopy structure of claim 1 wherein each of said motorized platforms includes a cable guide, said cable guide including a pair of spaced apart grooved bearings.

13. A method of maintaining a predetermined shaded area overtime, comprising the steps of:

providing a processor, and a canopy connected to motorized platforms by cables;

said processor adapted to calculate a first solar elevation and azimuth based on the latitude and longitude coordinates of a predetermined area to be shaded at a first period of time, and based on said calculation, said processor provides commands to each motorized platform to change the length of each cable so as to position said canopy to shade said predetermined area;

later in time, said processor calculates a second solar elevation and azimuth based on the latitude and longitude coordinates of a predetermined area to be shaded at a second period of time, and based on said calculation, said processor provides commands to each motorized platform to change the length of each cable so as to position said canopy to shade said predetermined area; and wherein two of said cables form a double stranded connection point and both of said cables forming said double stranded connection point are used to position said canopy.

14. The method of claim 13 wherein two of said cables form a double stranded connection point and one of said cables forming said double stranded connection point is used to position said canopy.

15. The method of claim 13 wherein two of said cables form a double stranded connection point and one of said cables forming said double stranded connection point is used to position said canopy around an obstruction.

* * * * *